US007956751B2

(12) United States Patent
Lenevez

(10) Patent No.: US 7,956,751 B2
(45) Date of Patent: Jun. 7, 2011

(54) SYSTEM FOR MINIMIZING COUPLING NULLS

(75) Inventor: Yves Lenevez, Aubagne (FR)

(73) Assignee: Tagsys SAS (FR)

( * ) Notice: Subject to any disclaimer, the term of this patent is extended or adjusted under 35 U.S.C. 154(b) by 980 days.

(21) Appl. No.: 11/881,994

(22) Filed: Jul. 30, 2007

(65) Prior Publication Data

US 2008/0048834 A1 Feb. 28, 2008

Related U.S. Application Data

(60) Provisional application No. 60/839,483, filed on Aug. 23, 2006.

(51) Int. Cl.

| | |
|---|---|
| ***G08B 13/14*** | (2006.01) |
| ***H01Q 7/04*** | (2006.01) |
| ***H01Q 1/44*** | (2006.01) |
| ***H01Q 19/00*** | (2006.01) |

(52) U.S. Cl. ..... 340/572.7; 340/572.1; 343/856; 343/842; 343/833

(58) Field of Classification Search ..... 340/572.1, 340/572.7; 343/856, 833, 842
See application file for complete search history.

(56) References Cited

U.S. PATENT DOCUMENTS

| | | | | |
|---|---|---|---|---|
| 5,293,172 | A * | 3/1994 | Lamberty et al. | 343/701 |
| 7,477,198 | B2 * | 1/2009 | Kanazawa et al. | 343/702 |
| 2004/0100413 | A1 * | 5/2004 | Waldner | 343/742 |
| 2005/0127177 | A1 * | 6/2005 | Dearing et al. | 235/385 |

FOREIGN PATENT DOCUMENTS

WO WO 2004074873 A1 * 9/2004

* cited by examiner

*Primary Examiner* — Benjamin C Lee
*Assistant Examiner* — Andrew Bee
(74) *Attorney, Agent, or Firm* — Lerner, David, Littenberg, Krumholz & Mentlik, LLP

(57) ABSTRACT

A system is disclosed for minimizing coupling nulls between an electromagnetic field derived from one or more sources and a plurality of randomly oriented RFID tags, wherein the electromagnetic field is rotated relative to the tags such that no tag is persistently located in a coupling null relative to the field. The source of the electromagnetic field may include a passive antenna or loop that changes its orientation relative to a direction of movement of the tags. The source of the electromagnetic field may further include an active antenna or loop that is electromagnetically coupled to the passive antenna or loop. A method for minimizing coupling nulls between the electromagnetic field and the randomly oriented tags is also disclosed.

8 Claims, 2 Drawing Sheets

SYSTEM FOR MINIMIZING COUPLING NULLS

CROSS-REFERENCE TO RELATED APPLICATIONS

This application claims the benefit of the filing date of U.S. Provisional Patent Application No. 60/839,483 filed Aug. 23, 2006, the disclosure of which is hereby incorporated herein by reference.

FIELD OF THE INVENTION

The present invention relates to a system for avoiding or at least minimizing coupling nulls between an electromagnetic field derived from one or more sources and a plurality of radio frequency identification (RFID) tags. The system may include an object management arrangement wherein information bearing electronically coded RFID tags are attached to objects which are to be identified, sorted, controlled and/or audited. In particular the system may avoid or at least minimize coupling nulls between an interrogator which creates an electromagnetic interrogation field and the electronically coded RFID tags.

BACKGROUND OF THE INVENTION

The object management arrangement may include information passing between the interrogator and the electronically coded tags, which respond by issuing a reply signal that is detected by the interrogator, decoded and consequently supplied to other apparatus in the sorting, controlling or auditing process. The objects to which the tags are attached may be animate or inanimate. In some variants of the system the frequency of the interrogating or powering field may range from LF to UHF or Microwave.

An electromagnetic source is required to create a field which may energise a tag's circuitry and/or illuminate an antenna associated with a tag for backscatter, depending on whether the tag is passive or active, eg. battery assisted.

To couple to all tags in a randomly oriented collection, when either a collection of tags or the field creation structure moves, a flux line must exist which couples to a tag in any orientation. This may be achieved simply by ensuring that multiple, eg. three, electromagnetic sources are used, each with its axis oriented in a different direction, with a most efficient case being three orthogonal directions of a Cartesian co-ordinate system. When two sources or multiple sources are used having only two unique source axes, a randomly oriented tag may not couple to a flux line when moved through the field or when the source structure is simply translated along one direction, and hence may not be read. However, if either the tag or antenna structure is itself rotated during traversal of the tag or translation of the antenna structure, the tag may couple to a flux line. Assuming that traversal and/or rotation allows a coupling flux line to dwell at a required direction for long enough, the tag should complete its reply and be read.

The present invention is related to apparatus disclosed in PCT application 2004/000175 entitled "System for Minimizing Coupling Nulls within an Electromagnetic Field", the disclosure of which is incorporated herein by cross reference. In the system disclosed in PCT application 2004/000175, the or each tag bearing object is translated and/or rotated relative to an electromagnetic field produced by a reading antenna such that no tag is persistently located in a coupling null relative to the field.

Reliable reading performance is possible with the prior art system under a condition that a tagged object is rotating or is otherwise changing its orientation relative to a reading antenna. However, a disadvantage of the system is that objects that do not rotate or otherwise change their orientation relative to a reading antenna many not be read reliably. Additionally, implementation of the antenna arrangement is relatively complex requiring a multiplexing device and switches that need to be monitored and adjusted by skilled operators. The system is therefore maintenance intensive and is prone to detuning and other undesirable effects.

An aim of the present invention is to provide a system for minimizing coupling nulls between an electromagnetic field associated with a tag reading antenna and a plurality of randomly oriented tags by dynamically changing the orientation of the electromagnetic field relative to a tag or tags as the tag or tags pass through or past the reading antenna.

SUMMARY OF THE INVENTION

According to one aspect of the present invention there is provided a system for at least minimizing coupling nulls between an electromagnetic field derived from one or more sources and a plurality of randomly oriented RFID tags, wherein said electromagnetic field is rotated relative to said tags such that no tag is persistently located in a coupling null relative to said field.

The or each source of the electromagnetic field may include one or more antennas or loops and/or portals and the plurality of tags may move relative to a region associated with each source. The or each antenna, loop or portal may be of any shape or form and may include an aperture through which the plurality of tags may pass.

The or each tag may be translated relative to the electromagnetic field. The or each source may include a main axis that is oriented obliquely relative to a direction of movement of the plurality of tags. The or each source of the electromagnetic field may include at least one passive antenna, loop or portal that is arranged such that its main axis changes orientation relative to the direction of movement of the tags. The passive antenna, loop or portal may be arranged to rotate relative to the direction of movement of the tags. The or each source of the electromagnetic field may include at least one active antenna, loop or portal that is electromagnetically coupled to the passive antenna or loop. The or each antenna, loop or portal may include an aperture through which the plurality of tags may pass. The main axis may be oriented at an acute angle relative to the direction of movement. The main axis may be oriented substantially at 45 degrees relative to the direction of movement. The or each tag may be arranged to rotate relative to the or each antenna, loop or portal during movement of the tags in the direction of movement.

The present invention may include use of a single loop antenna or portal of any shape such that persistent null coupling zones may be eliminated or minimized as the antenna or tag bearing objects pass through or past the antenna structure or the antenna structure is translated across the objects. Use of a set of crossed loops or portals, or multiple electromagnetic sources may be avoided in this manner.

According to a further aspect of the present invention there is provided a method for at least minimizing coupling nulls between an electromagnetic field derived from one or more sources and a plurality of randomly oriented RFID tags, said method including the step of rotating said electromagnetic field relative to the or each tag such that the or each RFID tag is not persistently located in a coupling null relative to said field.

The method may include translating the or each tag relative to the electromagnetic field. The method may include orienting a main axis of the or each source obliquely relative to a direction of movement of the plurality of RFID tags, wherein the or each source of the electromagnetic field includes one or more antennas or loops and/or portals and the plurality of tags moves relative to a region associated with the or each source. The method may include rotating the or each tag relative to the or each antenna, loop or portal during movement of the tags in the direction or movement.

When randomly oriented tags are present, a loop antenna having an axis that is oblique relative to a direction of movement of tag bearing objects may cause magnetic field lines to be cut by each tag if the antenna is rotated as the objects move through or past the aperture of the loop antenna.

A system as described herein may reduce far-field radiation from an electro-magnetic source for compliance with local Electro-Magnetic Compatibility (EMC) regulations by shielding the source. The size of the shield may be reduced with the aid of magnetic material.

BRIEF DESCRIPTION OF DRAWINGS

A preferred embodiment of the present invention will now be described with reference to the accompanying drawings wherein.

DESCRIPTION OF A PREFERRED EMBODIMENT

Figure 1:
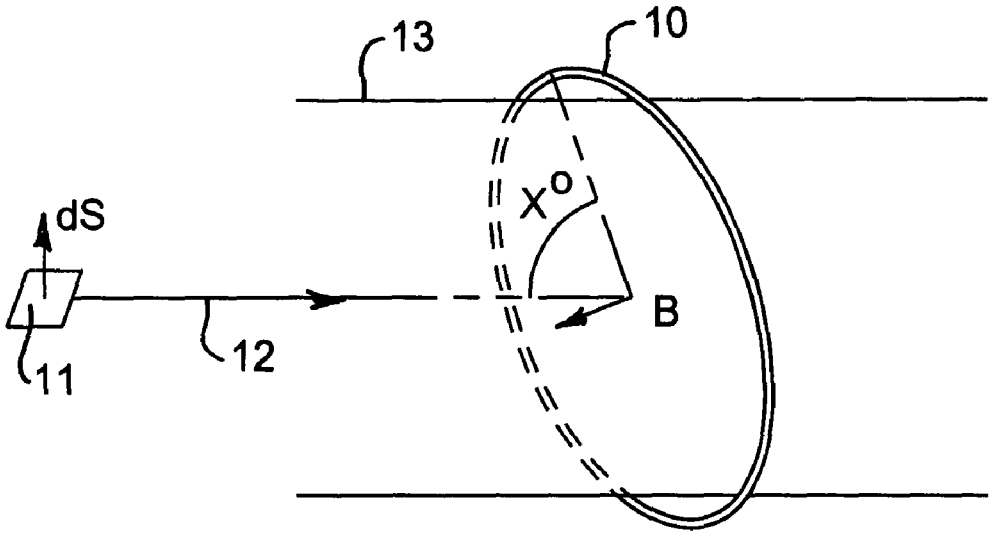
FIG. 1 shows an elliptical loop which forms a circular aperture vent arranged at an oblique angle relative to a direction of travel of an object.

An example of an antenna loop 10 is shown in FIG. 1. In FIG. 1 the direction of movement through antenna loop 10 of an object 11 bearing an RFID tag is along axis 12 associated with forming cylinder 13. In FIG. 1 the angle x formed between the direction of movement 12 and the plane of loop 10 may fall within the range 0<x<90 degrees. Using cylindrical symmetry, if the axis of loop 10 is oriented in a direction (pâp, ϕâϕ, zâz) where p#0 (oblique) and z#0 (aperture exists) then as magnetic flux density B at loop centre point is in the same direction, coupling to a randomly oriented tag relative to its axis of movement (âz) may be represented as a non-zero flux Ψ at some $\phi_{tag}$, wherein Ψ is the angle between the magnetic field B and the tag's axis which is taken to point in a direction dS. Then $$\begin{aligned}\Psi \propto B \cdot dS &= B_p(S_x\cos\phi_{tag} + S_y\sin\phi_{tag}) + \\ &\quad B_\phi(-S_x\sin\phi_{tag} + S_y\cos\phi_{tag}) + B_zS_z \\ &= B_p(S_x\cos\phi_{tag} + S_y\sin\phi_{tag}) + \\ &\quad B_zS_z \text{ as } B_\phi \text{ may be zero but } B_p\#0 \text{ and } B_z\#0 \\ &\quad \#0 \text{ for some } \phi_{tag}, \text{ as } S_x, S_y, \text{ and } S_z \\ &\quad \text{cannot all be simultaneously } 0\end{aligned}$$

Hence a single loop antenna 10 having its axis oriented with an oblique angle x relative to a direction of movement 12 of a tag bearing object 11 or translation of the antenna in conjunction with rotation of either the tag bearing object or the antenna should eliminate the effect of null coupling.

Figure 2:
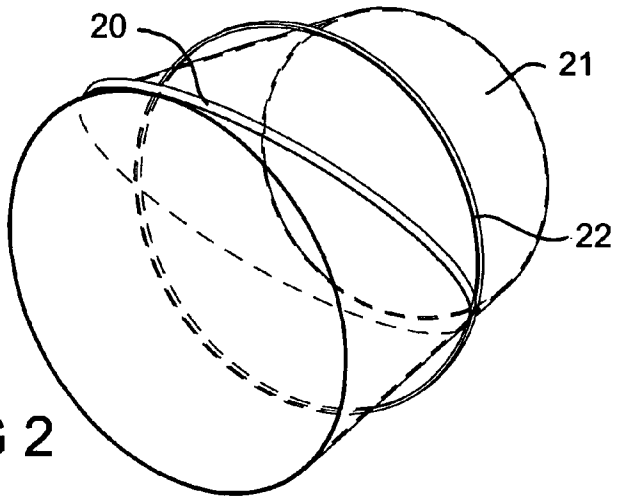
FIG. 2 shows a rotatable field antenna structure including passive (rotating) and active (fixed) antennas.

FIG. 2 shows a reading antenna structure including loop antenna 20 associated with rotatable forming cylinder 21. Cylinder 21 is rotatably mounted within an RFID reading tunnel (not shown). Loop antenna 20 is arranged to rotate with cylinder 21. As loop antenna 20 rotates, the associated electromagnetic field rotates with it to facilitate reading of tag bearing objects passing through the tunnel.

One problem with a rotating reading antenna is how to form a connection to cables feeding signals to the rotating antenna to and from transmitting and receiving circuits associated with the interrogator. The present invention addresses this problem by introducing a second antenna loop 22. The second antenna loop 22 may be fixed relative to the reading tunnel in closely spaced relationship to rotatable cylinder 21 and loop antenna 20.

Fixed antenna loop 22 may be actively coupled to the transmitting and receiving circuits associated with the interrogator. Fixed antenna loop 22 may include a construction that includes a self-balun method which entails cable entry at opposite ends of a break in a single turn loop in which tuning elements (not shown) may be located. Placing cable entry opposite the tuning elements may serve to electrically balance the loop with respect to ground for a loop which otherwise would be physically balanced with respect to ground. This approach may reduce far field radiation resulting from stray electric fields.

Rotatable antenna loop 20 forms a passive antenna that is electromagnetically coupled to fixed antenna loop 22. Because antenna loop 20 has a main axis that is oriented obliquely relative to a direction of movement of tag bearing objects, its axis changes orientation relative to the tag bearing objects as loop antenna 20 and cylinder 21 rotate. The electromagnetic field associated with antenna loop 20 also rotates and changes its orientation relative to the tag bearing objects as they pass through the reading tunnel. This facilitates reading of the tags and addresses coupling nulls between the reader antenna and the tags which are randomly oriented relative to the objects.

Figure 3:
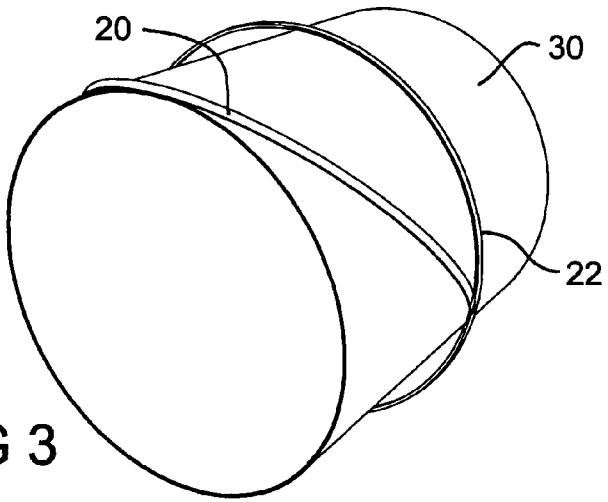
FIG. 3 shows the rotating field antenna structure of FIG. 2 including a transparent forming cylinder.

FIG. 3 shows (passive) rotatable loop antenna 20 formed on a transparent cylinder 30. As seen in FIG. 3 loop antenna 20 comprises a continuous elliptical conductor. The main axis of loop conductor 20 is oriented obliquely relative the axis of cylinder 30, which is also the direction of movement of tags passing through the tunnel reader. The elliptical conductor preferably is formed from a material that has a high conductivity such as gold or silver.

The main axis of loop conductor 20 may be oriented at an acute angle relative to the direction of movement of the tags. Preferably the main axis of loop conductor 20 is oriented at approximately 45 degrees relative to the direction of movement of tag bearing objects.

FIG. 3 also shows fixed (active) loop antenna 21. As seen in FIG. 3 fixed antenna 21 comprises a substantially circular loop formed from a conducting material. Antenna loop 21 surrounds transparent cylinder 30 and is spaced from cylinder 30 (and antenna loop 20) such that it is electromagnetically coupled with antenna loop 20 as cylinder 30 rotates. The main axis of antenna 21 is oriented substantially parallel to the main axis of cylinder 30, ie. the plane of antenna 21 is substantially perpendicular to the main axis of cylinder 30. Because antenna 21 is fixed it is relatively stable and easy to construct and maintain. Antenna loop 20 is a tuned to resonate at the interrogation frequency (or a multiple thereof) and acts as a relay a between a tag and fixed (active) antenna 21.

Antenna loop 20 may be rotated at any suitable rate to maintain an optimum reading rate. The speed of rotation may be controlled automatically depending upon reading requirements. In one form a relatively high rotating speed, for example 300 rpm, may be adapted to effectively create a 3D interrogation field. The 3D field is a real rotating field (not simulated by several antennas) that may allow a longer interrogation time of the tags and may provide a more robust reading operation without field interruptions. A tunnel reader incorporating a rotating antenna structure according to the present invention may be installed horizontally or vertically.

Figure 4:
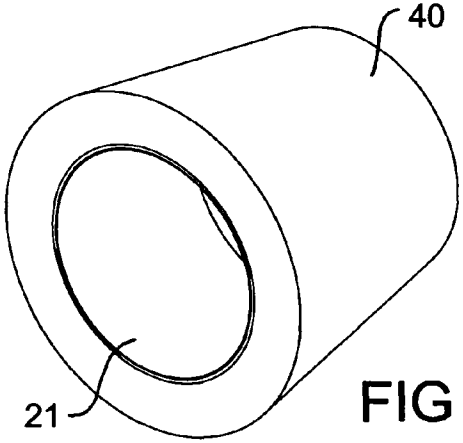
FIG. 4 shows a shielded rotating field antenna structure.

In the case of a magnetically coupled system in which tagged objects are passed through or in the vicinity by an aperture of a loop antenna or the antenna structure is translated across the objects, an electrical shield in the form of a tube may be placed around the loop antenna. The axes of the shield may be parallel to the direction of movement of the objects. FIG. 4 shows an example of an antenna structure as shown in FIGS. 2 and 3 encased in an electrical shield 40 parallel to the main axis of fixed antenna loop 22.

To electrically shield a circular loop with a conducting cylinder of diameter D1 with minimal detuning, the area in the plane of the loop between the loop and the shield can be thought of as requiring the same reluctance R presented to the flux as the cross-sectional area of the loop. It turns out that in this case where D2=√2D1 (and shield length>D1+loop height), the ratio of inductance with shield to inductance without shield is 0.84 (for a loop height to diameter ratio<0.1). For a ratio of inductance with shield to inductance without a shield of 0.95, the diameter of the shield is required to be twice that of the loop (D2=2D1). This latter amount of detuning is practically acceptable. The method described can also be used for a loop and shield cross-section of a regular polygon by considering the diameter of a circle circumscribed by the loop. Other more general shapes require calculation of flux paths.

The reason that a shield reduces inductance arises from a condition of shielding wherein the magnetic field outside the shield is zero (or very small). This being the case, a tangential magnetic field inside the shield material must likewise be zero. In order to maintain boundary conditions between the tangential magnetic field at the surface inside of the shield and the tangential magnetic field inside the shield material, a surface current on the inside edge of the shield must flow in order to produce a magnetic field inside the shield material which cancels the field that would have been in that region had the shield not existed. This current, however flows in anti-phase with that of the loop, so a subtracting field is present at the centre of the loop. As the definition of inductance is $L=N\Psi/I$, then a reduction in $\Psi$ causes a reduction in L (for constant I).

Likewise, $L=N^2/R$, where N is the number of turns of the loop, so a reduced flux path (as the shield closes in on the loop) has an increased reluctance R which is also consistent with reduced L.

Looking at why shielding is required in the first place, if a large loop is required for clearance of an object passing through the loop, two problem factors enter into the RFID system. One factor is that in order to maintain an acceptable field at the centre of the loop sufficient current must be provided from the interrogator. As a loop's perimeter becomes larger, the radiation properties diverge from that of an electrically small loop due to non-uniform current distribution around the loop, resulting in increased radiation. The loop can be constructed by segmenting the periphery into segments joined by series capacitors of low enough reactance to not affect the matching of the loop or with a judicious choice of reactance to facilitate the matching. An alternative segmentation in the form of "pie slice" sections whose effect from the radial currents cancel is not practical for an object passing through and a further implementation where the feed is external to the loop and (possibly the shield) is unwieldy in complexity. Once the loop behaves as an electrically small loop, shielding becomes one solution to further reduce radiation to acceptable EMC limits.

A second factor is that a larger loop picks up more external noise through reciprocal reasoning of why it radiates more.

With a shield causing a reduction in inductance, a direct reduction in flux (and hence H) for the same current occurs, therefore increased current is required from the interrogator leading to increased power output and internal interrogator noise.

Other multiple antenna configurations are possible to create a field and such structures may require shielding from external noise or attenuation of propagating field in one direction for which a technique as described below may be equally suitable. Nevertheless, a single loop is desired in most applications due to its simplicity.

To reduce the diameter of the shield, a material with a higher permeability than that of air may be used between the loop and the shield to provide a lower reluctance path. To calculate a required amount of magnetic material to be placed between the loop and the shield, a value of reluctance may be provided that would result in the value of the loop's initial inductance in the absence of the shield. A material such as ferrite is desirable due to its low conductivity, which prevents (or at least keeps to a minimum) surface currents on the magnetic material which may act in the same way as currents on the inside of the shield. For the case of conducting material, it may be laminated in planes perpendicular to a line around the perimeter and may require more material (increase the inductance to a value greater than the loop) to counteract inductance reducing effect of the surface currents.

Large toroids or flat disks with holes in the centre are not commonly available so practically, the magnetic material may be in the form of rods or slabs placed in a picket fence or polygon fashion respectively. For the latter structures, a demagnetising factor associated with the material may be estimated by the following formulas.

For a rod of diameter d and length L, $$N_d=(1-w^2)/w^2*(1/(2w)*\ln((1+w)/(1-w))-1),\text{ where } w=\sqrt{(1-(d/L)^2)}.$$

The effective permeability is then calculated by $$\mu_{eff}=\mu_r/(1+(\mu_r-1)N_d).$$

The reluctance of a magnetic pathway is $R=l/(\mu S)$ where l is the centre-line length and S is the area of cross section. For the case of using rods, reluctance of a single rod may be calculated and the reluctance of each rod is one of n in parallel in the magnetic circuit, so $$L_{loop}=N^2/(R_{rod}/n)$$

is used to find the number of rods required.

This method may get close to a final requirement of magnetic material, but the volume of magnetic material may require adjustment for the following reasons. Firstly the formula for reluctance assumes uniform magnetic field at the air magnetic material interface, which is approximately true for narrow rods or slabs. Secondly, the rods need to be long enough to maintain enough radius of curvature of the flux lines at the centre of the loop in order for a randomly oriented tag to dwell long enough to couple to the field while it passes through the loop. This second case relates to two inductors having the same value of inductance, but with differing distributions of field within their turns. Using a thin wall cylinder as the loop (a loop with some height) may assist in keeping the radius of curvature of the field at the centre from becoming too small for good tag coupling when a single turn loop is used.

To complete the shielding, a shield length>D1+loop height may be required to allow enough flux return area for a cylinder with closed ends. In order to pass objects through the loop, the ends may be required to be opened, thus relaxing this requirement, but in order to prevent too much field escaping the cylinder ends, the tube's length preferably is made such that it acts as a waveguide beyond cut-off, which may apply attenuation to the wave present at the operating frequency. For a magnetic loop case, the arrangement may launch a $TE_{22}$ wave mode, although a conservative approach may be to make the shield long enough to give a required attenuation for the dominant mode. The attenuation required comes from the amount that the unshielded loop was over the EMC limit. The length, l, with the source at the centre of the waveguide, is related to attenuation by the formula:

$$[\text{attenuation dB}]=20*\log 10*\exp(-j\beta*l/2)$$

where β will be complex when operating below the cut-off frequency.

Finally, it is to be understood that various alterations, modifications and/or additions may be introduced into the constructions and arrangements of parts previously described without departing from the spirit or ambit of the invention.

The invention claimed is:

1. A system for at least minimizing coupling nulls between an electromagnetic field and a plurality of randomly oriented RFID tags;

wherein said electromagnetic field includes a main axis that is oriented obliquely and is rotated relative to a direction of movement of said plurality of RFID tags;

said electromagnetic field being derived from an active fixed loop antenna having an inscribed circle having a first diameter and an axis, and a mechanically separate passive rotating loop antenna that lies in a non-parallel plane relative to said fixed loop antenna, said rotating loop antenna being circumscribed by an ellipse whose cylinder of rotation has a second diameter and is coaxially disposed about said axis of said fixed loop antenna; and said second diameter being less than said first diameter such that said fixed loop antenna and said rotating loop antenna are electromagnetically coupled, said plurality of RFID tags being arranged to travel within dimensions of said fixed loop antenna and said rotating loop antenna such that no tag is persistently located in a coupling null relative to said electromagnetic field.

2. A system according to claim 1 wherein said main axis of said electromagnetic field is oriented at an acute angle relative to said direction of movement of said plurality of RFID tags.

3. A system according to claim 1 wherein said main axis of said electromagnetic field is oriented substantially at 45 degrees relative to said direction of movement of said plurality of RFID tags.

4. A system according to claim 1 wherein each of said plurality of RFID tags is arranged to rotate relative to said fixed loop antenna during movement of said RFID tag in said direction of movement.

5. A method for at least minimizing coupling nulls between an electromagnetic field and a plurality of randomly oriented RFID tags, wherein said electromagnetic field is derived from an active fixed loop antenna having an inscribed circle having a first diameter and an axis, and a mechanically separate passive loop antenna that lies in a non-parallel plane relative to said fixed loop antenna, said separate loop antenna being circumscribed by an ellipse whose cylinder of rotation has a second diameter and is coaxially disposed about said axis of said fixed loop antenna, said second diameter being less than said first diameter such that said fixed loop antenna and said separate loop antenna are electromagnetically coupled, said method including the steps of:

orienting a main axis of said electromagnetic field obliquely relative to a direction of movement of said plurality of RFID tags;

rotating said separate loop antenna to cause rotation of said electromagnetic field relative to said direction of movement of said plurality of RFID tags; and passing said plurality of RFID tags within dimensions of said fixed loop antenna and rotating separate loop antenna such that no tag is persistently located in a coupling null relative to said electromagnetic field.

6. A method according to claim 5 wherein said main axis of said electromagnetic field is oriented at an acute angle relative to said direction of movement of said plurality of RFID tags.

7. A method according to claim 5 wherein said main axis of said electromagnetic field is oriented substantially at 45 degrees relative to said direction of movement of said plurality of RFID tags.

8. A method according to claim 5 including rotating each of said plurality of RFID tags relative to said fixed loop antenna during movement of said plurality of RFID tags in said direction of movement.

* * * * *